US009620057B2

(12) United States Patent
Ren et al.

(10) Patent No.: US 9,620,057 B2
(45) Date of Patent: Apr. 11, 2017

(54) METHOD AND APPARATUS FOR ADJUSTING DRIVING VOLTAGE FOR PIXEL CIRCUIT, AND DISPLAY DEVICE

(71) Applicant: BOE TECHNOLOGY GROUP CO., LTD., Beijing (CN)

(72) Inventors: Lijun Ren, Beijing (CN); Szuheng Tseng, Beijing (CN); Chen Zhang, Beijing (CN)

(73) Assignee: BOE TECHNOLOGY GROUP CO., LTD. (CN)

( * ) Notice: Subject to any disclaimer, the term of this patent is extended or adjusted under 35 U.S.C. 154(b) by 0 days.

(21) Appl. No.: 14/367,717

(22) PCT Filed: Dec. 18, 2013

(86) PCT No.: PCT/CN2013/089768

§ 371 (c)(1),
(2) Date: Jun. 20, 2014

(87) PCT Pub. No.: WO2015/021721

PCT Pub. Date: Feb. 19, 2015

(65) Prior Publication Data

US 2015/0049070 A1 Feb. 19, 2015

(30) Foreign Application Priority Data

Aug. 16, 2013 (CN) ..... 2013 1 0358943

(51) Int. Cl.
*G09G 3/36* (2006.01)
*G09G 3/3233* (2016.01)

(52) U.S. Cl.
CPC ... *G09G 3/3233* (2013.01); *G09G 2300/0842* (2013.01); *G09G 2330/02* (2013.01); *G09G 2330/028* (2013.01)

(58) Field of Classification Search
CPC ..... G09G 5/00; G09G 5/10; G09G 3/3696; G09G 3/3258; G09G 3/3275;
(Continued)

(56) References Cited

U.S. PATENT DOCUMENTS 6,885,356 B2 4/2005 Hashimoto
2011/0069096 A1* 3/2011 Li ..... G09G 3/2081 345/690

(Continued)

FOREIGN PATENT DOCUMENTS

CN 1680988 10/2005
CN 1744180 3/2006

(Continued)

OTHER PUBLICATIONS

International Search Report and Written Opinion of the International Searching Authority issued in corresponding International Application No. PCT/CN2013/089768 dated Apr. 29, 2014.

(Continued)

*Primary Examiner* — Lun-Yi Lao
*Assistant Examiner* — Johny Lau
(74) *Attorney, Agent, or Firm* — BakerHostetler LLP

(57) ABSTRACT

In the method provided by the present disclosure, the driving voltage for the pixel circuit is dynamically adjusted in accordance with data voltages in each pixel row. Accordingly, as compared with a traditional method where a constant voltage is applied to the pixel circuit, the method provided therein is able to greatly reduce a dynamic loss and a temperature rise of an OLED pixel circuit and prolong the life of the OLED while reducing the driving cost.

7 Claims, 2 Drawing Sheets

(58) Field of Classification Search
CPC ..... G09G 3/3233; G09G 2300/0842; G09G 2330/02; G09G 2300/028
See application file for complete search history.

(56) References Cited

U.S. PATENT DOCUMENTS

| | | | | |
|---|---|---|---|---|
| 2011/0134157 | A1* | 6/2011 | Chaji | G09G 3/3233 345/690 |
| 2011/0273425 | A1 | 11/2011 | Kojima et al. | |
| 2012/0293481 | A1 | 11/2012 | Chaji | |
| 2013/0181969 | A1* | 7/2013 | Kishi | G09G 3/3233 345/212 |

FOREIGN PATENT DOCUMENTS

| | | | |
|---|---|---|---|
| CN | 101014989 | | 8/2007 |
| CN | 101826292 | | 9/2010 |
| CN | 102203845 | | 9/2011 |
| CN | 102714020 | | 10/2012 |
| CN | 102831865 | | 12/2012 |
| EP | 1 916 647 | A1 | 4/2008 |
| JP | 2006065148 | | 3/2006 |
| JP | 2008310361 | | 12/2008 |
| JP | 2009069485 | | 4/2009 |
| JP | 2011118300 | | 6/2011 |
| WO | 2006/113922 | A2 | 10/2006 |

OTHER PUBLICATIONS

Office Action issued in corresponding Chinese Application No. 201310358943.7 dated Feb. 4, 2015.
Office Action issued in corresponding Korean Application No. 10-2014-7017098 dated Apr. 30, 2015.
Extended European Search Report in European Patent Application No. 13861488.8, dated Nov. 13, 2015.
Communication in European Patent Application No. 13 861 488.8, dated Oct. 5, 2016.
Communication in European Patent Application No. 13 861 488.8, dated Jan. 4, 2017.

* cited by examiner

-PRIOR ART-

--PRIOR ART--

METHOD AND APPARATUS FOR ADJUSTING DRIVING VOLTAGE FOR PIXEL CIRCUIT, AND DISPLAY DEVICE

CROSS-REFERENCE TO RELATED APPLICATION

This application is the U.S. national phase of PCT Application No. PCT/CN2013/089768 filed on Dec. 18, 2013, which claims priority to Chinese Patent Application No. 201310358943.7 filed on Aug. 16, 2013, the disclosures of which are incorporated in their entirety by reference herein.

TECHNICAL FIELD

The present disclosure relates to the field of display technology, in particular to a method and an apparatus for adjusting a driving voltage for a pixel circuit, and a display device comprising such an apparatus.

BACKGROUND

As compared with a traditional liquid crystal panel, an active matrix/organic light-emitting diode (AMOLED) panel has such features as rapid response, high contrast and wide viewing angle, so there is a growing concern about AMOLED for display technology developers.

The AMOLED is driven by a pixel circuit to emit light. An existing 2T1C sub-pixel 10 consists of two thin film transistors (TFTs) and one capacitor (C), i.e., a driving TFT DTFT, a switch TFT T1 and a storage capacitor Cst as shown in FIG. 1. The switch TFT T1 is controlled by a scanning signal Vscan so as to control the input of a data voltage Vdata, the driving TFT DTFT is configured to control an OLED to emit light, and the storage capacitor C is configured to apply a maintaining voltage to a gate electrode of the driving TFT DTFT.

FIG. 2 is a driving sequence diagram of the 2T1C sub-pixel 10 in FIG. 1. A working procedure of the 2T1C sub-pixel 10 may be described as follows. When the scanning signal Vscan is at a high level, the switch TFT T1 is switched on, and the storage capacitor Cst is charged by a gray scale voltage Vdata on a data line. Meanwhile, the data voltage Vdata is applied to the gate electrode of the driving TFT DTFT, and the driving TFT DTFT is driven by a driving voltage ELVDD for the pixel circuit so as to operate in a saturation state, thereby to drive the OLED to emit light. When the scanning signal Vscan is at a low level, the switch TFT T1 is switched off, the maintaining voltage is applied by the storage capacitor Cst to the gate electrode of the driving TFT DTFT, and the driving TFT DTFT is driven by the driving voltage ELVDD so as to still operate in the saturation state, thereby to enable the OLED to emit light continuously. In the prior art, in order to ensure the driving TFT DTFT to operate in a saturation region and emit light normally, usually a relatively high driving voltage ELVDD is applied to a source electrode of the driving TFT DTFT of the OLED pixel circuit, and a value of the driving voltage remains unchanged, i.e., the OLED is driven at a constant voltage. However, at certain timings, e.g., when the data voltage is very low and a high driving voltage is not required, a power loss will take place and a temperature of an element will increase if a high voltage is applied. Hence, an existing method for adjusting the driving voltage for the 2T1C sub-pixel 10 may cause a great dynamic loss and a large temperature rise.

SUMMARY

An object of the present disclosure is to provide a method and an apparatus for adjusting a driving voltage for a pixel circuit, so as to reduce a dynamic loss and a temperature rise of an OLED pixel circuit and prolong the life of the OLED while reducing the driving cost.

In one aspects the present disclosure provides a method for adjusting a driving voltage for a pixel circuit, so as to dynamically adjust the driving voltage, for the pixel circuit in accordance with data voltages in each pixel row. The pixel circuit comprises a plurality of sub-pixel circuits forming a plurality of pixel rows.

Alternatively, the method may comprise:

acquiring data voltages for each sub-pixel circuit in a pixel row to be scanned in the pixel circuit, the sub-pixel circuit comprising a driving TFT and a light-emitting element;

calculating, in accordance with the data voltages, a minimum driving voltage for each sub-pixel circuit in the pixel row to be scanned, the minimum driving voltage being a minimum voltage that ensures the driving TFT to operate in a saturation region and ensures the light-emitting element to emit light normally;

selecting a maximum value from among the minimum driving voltages for the sub-pixel circuits in the pixel row to be scanned, and configuring the maximum value as a maximum driving voltage for the pixel row to be scanned; and configuring a maximum value from among the determined maximum driving voltage for the pixel row to be scanned and maximum driving voltages for all pixel rows before the pixel row to be scanned, as the driving voltage for the pixel circuit.

Alternatively, the method may comprise:

acquiring a maximum driving voltage $M_1$ for a first pixel row in the pixel circuit;

configuring $M_1$ as a driving voltage for the pixel circuit;

acquiring a maximum driving voltage $M_2$ for a second pixel row in the pixel circuit and comparing $M_1$ with $M_2$;

if $M_1<M_2$, maintaining the value of $M_2$, and if $M_1 \geq M_2$, assigning the value of $M_1$ to $M_2$;

configuring $M_2$ as the driving voltage for the pixel circuit;

. . . ;

acquiring a maximum driving voltage $M_n$ for an $n^{th}$ pixel row and comparing $M_{n-1}$ with $M_n$;

if $M_{n-1}<M_n$, maintaining the value of $M_n$, and if $M_{n-1} \geq M_n$, assigning the value of $M_{n-1}$ to $M_n$; and configuring $M_n$ as the driving voltage for the pixel circuit, wherein n is an integer greater than 2.

In another aspect, the present disclosure also provides an apparatus for adjusting a driving voltage for a pixel circuit, comprising a driving power IC coupled to the pixel circuit, and an operational processing module coupled to the driving power IC and configured to dynamically adjust a driving voltage applied by the driving power IC to the pixel circuit in accordance with data voltages for each pixel row in the pixel circuit.

The operational processing module may comprise:

a row buffering unit configured to acquire the data voltages for each sub-pixel circuit in a pixel row to be scanned in the pixel circuit; and a calculating unit configured to calculate a minimum driving voltage for each sub-pixel circuit in the pixel row to be scanned in accordance with the data voltages, select a maximum value from among the minimum driving voltages, configure the maximum value as a maximum driving voltage for the pixel row to be scanned, and transmit a maximum value selected from among the maximum driving voltage for the pixel row to be scanned and maximum driving voltages for all pixel rows before the pixel row to be scanned, as a value of the driving voltage for the pixel circuit, to the driving power IC.

The operational processing module may be integrated into the driving power IC.

In yet another aspect, the present disclosure also provides a display device comprising the above-mentioned apparatus for adjusting a driving voltage for a pixel circuit.

According to the method and apparatus for adjusting the driving voltage for the pixel circuit provided by the present disclosure, the driving voltage applied to the pixel circuit is dynamically adjusted in accordance with the data voltages for each pixel row in the pixel circuit. And as compared with a traditional method where a constant voltage is applied to the pixel circuit, it is able to greatly reduce the dynamic loss and the temperature rise of the OLED pixel circuit and prolong the life of the OLED while reducing the driving cost.

DETAILED DESCRIPTION

The present disclosure will be described hereinafter in conjunction with the drawings and the embodiments. The following embodiments are merely for illustrative purposes, but shall not be used to limit the present invention.

According to a method and an apparatus for adjusting a driving voltage for a pixel circuit provided by the present disclosure, the pixel circuit driving voltage may be adjusted in accordance with a dynamic change of data voltages for each row of the pixel circuit, and as compared with a traditional method where a constant voltage is applied to the pixel circuit, it is able to greatly reduce a dynamic loss and a temperature rise of an OLED pixel circuit and prolong the life of the OLED while reducing the driving cost.

The present disclosure provides a method for adjusting a driving voltage for a pixel circuit, so as to dynamically adjust the driving voltage for the pixel circuit in accordance with data voltages for each pixel row. The pixel circuit includes a plurality of sub-pixel circuits, and the driving voltage for the pixel circuit means a driving voltage ELVDD for the whole pixel circuit, which is applied to each sub-pixel circuit.

One implementation mode of the method for adjusting the driving voltage for the pixel circuit may comprise the following steps:

acquiring data voltages for each sub-pixel circuit in a pixel row to be scanned in the pixel circuit;

calculating a minimum driving voltage for each sub-pixel circuit in the pixel row to be scanned in accordance with the acquired data voltages, the minimum driving voltage for the sub-pixel circuit being at least sufficient to ensure a driving TFT of the sub-pixel circuit to operate at a saturation region, thereby to ensure an OLED to emit light normally;

selecting a maximum value from among the calculated minimum driving voltages as a maximum driving voltage for the pixel row to be scanned, the maximum driving voltage being sufficient to ensure each sub-pixel, circuit in the pixel row to be scanned to operate normally; and comparing the maximum driving voltage for the pixel row to be scanned with a maximum driving voltage for all pixel rows before the pixel row to be scanned, which is also determined by the method, and configuring a maximum value as the driving voltage of the pixel circuit, the resultant driving voltage being sufficient to ensure the driving TFT of each sub-pixel circuit in the pixel row to be scanned to be in a saturation state, without affecting an operational state of each sub-pixel circuit in the pixel rows that have been scanned.

Figure 1:
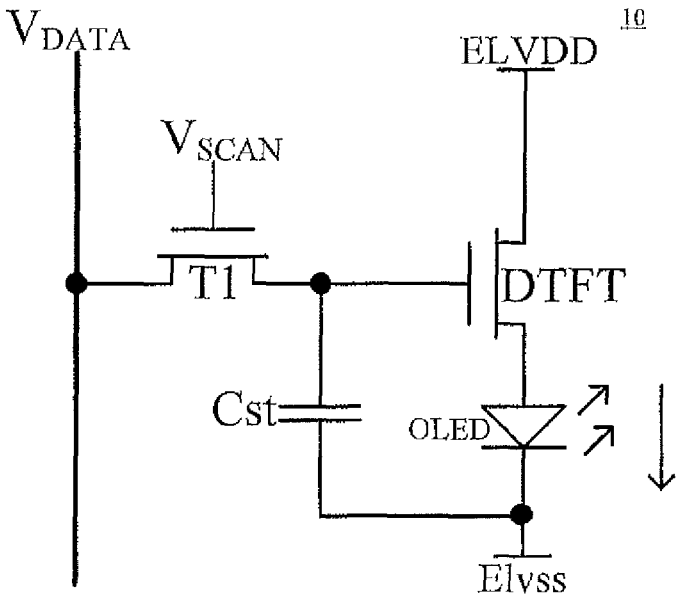
FIG. 1 is a schematic view showing a conventional pixel circuit.
Figure 2:
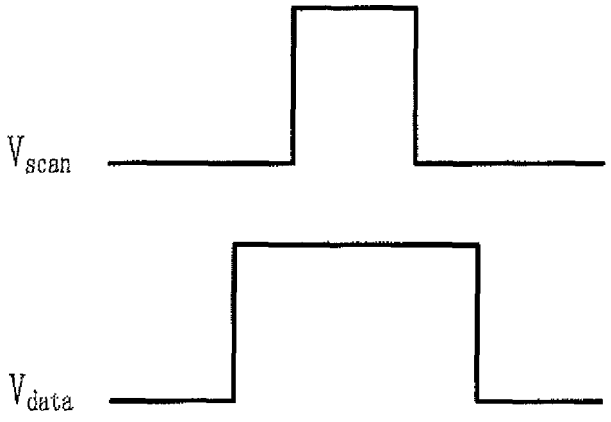
FIG. 2 is a driving sequence diagram of the pixel circuit in FIG. 1.
Figure 3:
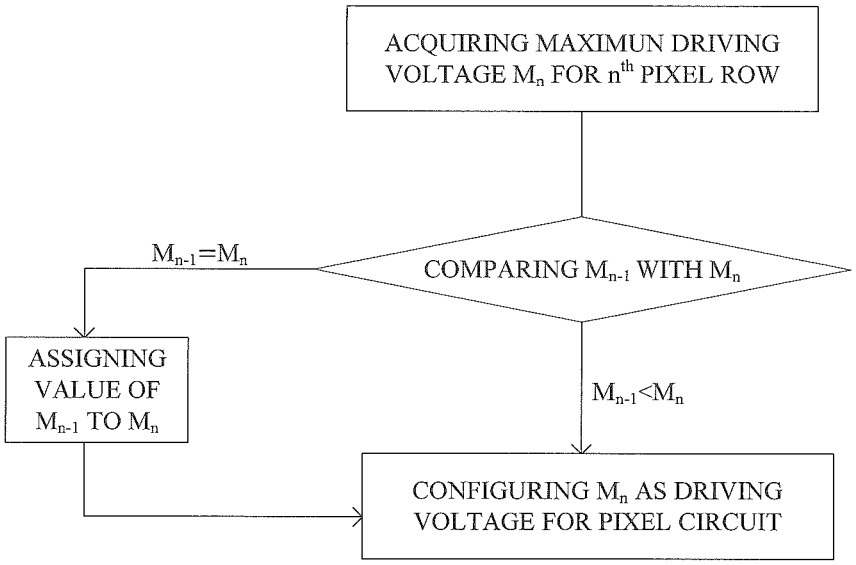
FIG. 3 is a flow chart of a method for adjusting a driving voltage for a pixel circuit according to the present disclosure.

In this embodiment, a display panel with a resolution of 1024*768 is taken as an example. The display panel comprises an array substrate and a counterpart substrate arranged in alignment to each other. Gate scanning lines and data lines, which are arranged on the array substrate in an interweave manner, define a plurality or sub-pixel regions, each of which comprises a pixel circuit (hereinafter referred to as a sub-pixel circuit) as shown in FIG. 1. These sub-pixel circuits form the pixel circuit on the array substrate, and R, G and B sub-pixels form a pixel unit. Hence, the display panel with the resolution of 1024*768 comprises 768 gate scanning lines and 1024*3=3072 data lines. Each gate scanning line is coupled to a gate electrode of a switch TFT T1 in the sub-pixel circuit, and each data line is coupled to a source electrode of the switch TFT T1. As shown in FIG. 3, when the method is used to apply a driving voltage ELVDD to the source electrode of the driving TFT DTFT in the sub-pixel circuit, it mainly comprises the following steps.

At first, it is required to scan a first pixel row, and prior to the scanning, it is required to:

acquire data voltages for each sub-pixel circuit in the first pixel row, i.e., acquire data voltages for 3072 data lines in the first pixel row;

calculate a minimum driving voltage for each sub-pixel circuit in the first pixel row in accordance with the acquired 3072 data voltages to obtain 3072 minimum driving voltages, the minimum driving voltage for the sub-pixel circuit being at least sufficiently to ensure the driving TFT DTFT of the sub-pixel circuit to operate in a saturation region, thereby to ensure an OLED to emit light normally;

select a maximum value from among the obtained 3072 minimum driving voltages as a maximum driving voltage $M_1$ for the first pixel row, $M_1$ being sufficient to ensure all sub-pixel circuits in the first pixel row to operate normally; and apply $M_1$ to the pixel circuit as the driving voltage ELVDD for the pixel circuit.

Then, the first pixel row starts to be scanned. The gate scanning line in a first row outputs a scanning signal so as to switch on the switch TFT T1 in each sub-pixel circuit in the first pixel row, and the data line writes the data voltage into a storage capacitor Cst via the switch TFT T1 in the sub-pixel circuit.

After the data voltage is written into the storage capacitor Cst, the gate scanning line in the first row stops outputting the scanning signal, the switch TFT T1 in each sub-pixel circuit in the first pixel row is switched off, and the OLED in the first pixel row emits light normally.

Next, it is required to scan a second pixel row, and prior to the scanning, it is required to:

acquire data voltages for each sub-pixel circuit in the second pixel row, i.e., acquire data voltages for 3072 data lines in the second pixel row;

calculate a minimum driving voltage for each sub-pixel circuit in the second pixel row in accordance with the acquired 3072 data voltages, to obtain 3072 minimum driving voltages, the minimum driving voltage for the sub-pixel circuit being at least sufficient to ensure the driving TFT DTFT of the sub-pixel circuit to operate in the saturation region, thereby to ensure the OLED to emit light normally;

select a maximum value from among the obtained 3072 minimum driving voltages as a maximum driving voltage $M_2$ for the second pixel row, $M_2$ being sufficient to ensure all the sub-pixel circuits in the second pixel row to operate normally;

compare the maximum driving voltage $M_1$ for the first pixel row with the maximum driving voltage $M_2$ for the second pixel row, if $M_1<M_2$, maintain the value of $M_2$, and if $M_1 \geq M_2$, assign the value of $M_1$ to $M_2$; and apply $M_2$ to the pixel circuit as the driving voltage ELVDD for the pixel circuit, so as to ensure the driving TFTs of all the sub-pixel circuits in the first and second rows to operate in the saturation region, thereby to ensure the OLEDs in the first and second rows to emit light normally.

Then, the second pixel row starts to be scanned. The gate scanning line in a second row outputs a scanning signal so as to switch on the switch TFT T1 in each sub-pixel circuit in the second pixel row, and the data line writes a data voltage into the storage capacitor Cst via the switch TFT T1 in the sub-pixel circuit.

After the data voltage is written into the storage capacitor Cst, the gate scanning line in the second row stops outputting the scanning signal, the switch TFT T1 in each sub-pixel circuit in the second pixel row is switched off, and the OLEDs in the first and second rows emit light normally.

The calculation and scanning will be performed on the subsequent pixel rows in the pixel circuit in a similar manner.

For the $n^{th}$ pixel row, prior to the scanning, it is required to:

acquire data voltages for each sub-pixel circuit in the $n^{th}$ pixel row, i.e., acquire data voltages for 3072 data lines in the $n^{th}$ pixel row;

calculate a minimum driving voltage for each sub-pixel circuit in the $n^{th}$ pixel row in accordance with the acquired 3072 data voltages, so as obtain 3072 minimum driving voltages, the minimum driving voltage for the sub-pixel circuit being at least sufficient to ensure the driving TFTs of the sub-pixel circuit to operate in the saturation region, thereby to ensure the OLED to emit light normally;

select a maximum value from among the obtained 3072 minimum driving voltages as a maximum driving voltage $M_n$ for the $n^{th}$ pixel row, $M_n$ being sufficient to ensure all the sub-pixel circuits in the $n^{th}$ pixel row to operate normally;

compare a maximum driving voltage $M_{n-1}$ for an $(n-1)^{th}$ pixel row with the maximum driving voltage $M_n$ for the $n^{th}$ pixel row, if $M_{n-1}<M_n$, maintain the value of $M_n$, and if $M_{n-1} \geq M_n$, assign the value of $M_{n-1}$ to $M_n$; and apply $M_n$ to the pixel circuit as the driving voltage ELVDD for the pixel circuit, so as to ensure the driving TFTs of all the sub-pixel circuits in the first to the $n^{th}$ pixel rows to operate in the saturation region, thereby to ensure the OLEDs in the first to the $n^{th}$ pixel rows to emit light normally.

Then, the $n^{th}$ pixel row starts to be scanned. The gate scanning line in the $n^{th}$ row outputs a scanning signal so as to switch on the switch TFT T1 in each sub-pixel circuit in the $n^{th}$ pixel row, and the data line writes the data voltage into the storage capacitor Cst via the switch TFT T1 in the sub-pixel circuit.

After the data voltage is written into the storage capacitor Cst, the gate scanning line in the $n^{th}$ row stops outputting the scanning signal the switch TFT T1 in each sub-pixel circuit in the $n^{th}$ pixel row is switched off, and the OLEDs in the first to the $n^{th}$ pixel rows emit light normally.

The scanning is performed as mentioned above until the $768^{th}$ pixel row is scanned. Here, n represents a serial number of the pixel row in the pixel circuit, and it is an integer greater than 2 and not greater than 768.

Figure 4:
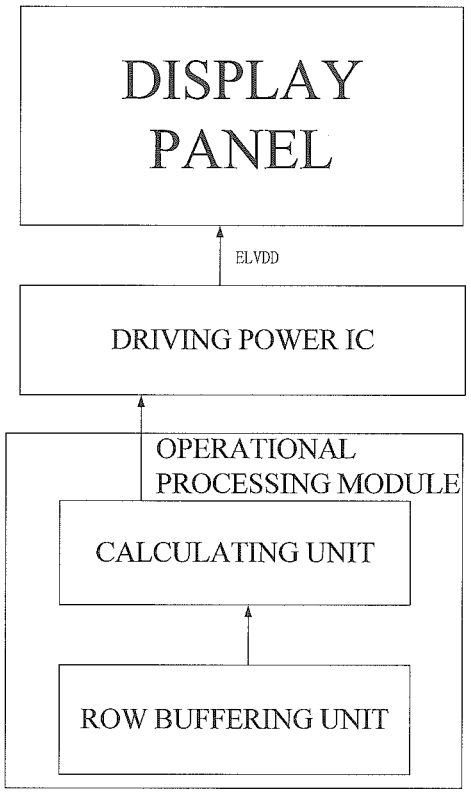
FIG. 4 is a schematic view showing an apparatus for adjusting a driving voltage for a pixel circuit according to the present disclosure.

The present disclosure further provides an apparatus for adjusting a driving voltage for a pixel circuit. And as shown in FIG. 4, the apparatus mainly comprises a driving power IC coupled to the pixel circuit and an operational processing module coupled to the driving power IC. The driving power IC is configured to apply a driving voltage to the pixel circuit, and the operational processing module is configured to dynamically adjust the driving voltage applied by the driving power IC to the pixel circuit in accordance with data voltages for each pixel row.

The operational processing module may comprise:

a row buffering unit configured to acquire a plurality of data voltages for a pixel row to be scanned, and store therein the data voltages from each data line in each pixel row; and a calculating unit configured to read the data voltages in the row buffering unit, calculate a minimum driving voltage for each sub-pixel circuit in a pixel row to be scanned in accordance with the data voltages, select a maximum value from among the minimum driving voltages, configure the maximum value as a maximum driving voltage, determine a maximum value selected from the maximum driving voltage for the pixel row to be scanned and maximum driving voltages for all pixel rows before the pixel row to be scanned as a driving voltage ELVDD for the pixel circuit, and transmit it to a driving power IC that drives a display panel to display in accordance with the received driving voltage ELVDD.

In this embodiment, the operational processing module may be integrated into the driving power IC so as to miniaturize the apparatus and reduce the production cost.

The present disclosure further provides a display device comprising the above-mentioned apparatus for adjusting the driving voltage, for the pixel circuit. For example, the display device is an active matrix/organic, light-emitting diode (AMOLED) display device. According to the apparatus having the OLED pixel circuit, it is able to greatly reduce the dynamic loss and the temperature rise of the OLED pixel circuit and prolong the life of the OLED while reducing the driving cost. As a result, it is able to prolong the life of the display device and improve the reliability thereof.

The above are merely the preferred embodiments of the present invention, but shall not be used to limit the present invention. A person skilled in the art may further make improvements and modifications without departing from the principle of the present invention, and these improvements and modifications shall also fall within the scope of the present invention.

What is claimed is:

1. A method for adjusting a driving voltage for a pixel circuit, wherein the pixel circuit comprises a plurality of sub-pixel circuits forming a plurality of pixel rows, the method comprising:

acquiring data voltages for each sub-pixel circuit in a pixel row to be scanned in the pixel circuit, the sub-pixel circuit comprising a driving thin film transistor (TFT) and a light-emitting element;

calculating, in accordance with the data voltages, a minimum driving voltage for each sub-pixel circuit in the pixel row to be scanned, the minimum driving voltage being a minimum voltage that ensures the driving TFT to operate in a saturation region and ensures the light-emitting element to emit light normally;

selecting a maximum value from among the minimum driving voltages for the sub-pixel circuits in the pixel row to be scanned, and configuring the maximum value as a maximum driving voltage for the pixel row to be scanned; and comparing the determined maximum driving voltage for the pixel row to be scanned with maximum driving voltages for one immediately previous row before the pixel row to be scanned, keeping the determined maximum driving voltage for the pixel row to be scanned unchanged, in response to a first determination result where the determined maximum driving voltage for the pixel row to be scanned unchanged is greater than the maximum driving voltages for the one immediately previous row before the pixel row to be scanned, and changing the determined maximum driving voltage for the pixel row to be scanned unchanged into the maximum driving voltages for the immediately previous row before the pixel row to be scanned, in response to a second determination result where the determined maximum driving voltage for the pixel row to be scanned unchanged is smaller than or equal to the maximum driving voltages for the one immediately previous row before the pixel row to be scanned.

2. The method according to claim 1, comprising:

acquiring a maximum driving voltage $M_1$ for a first pixel row in the pixel circuit;

configuring $M_1$ as a driving voltage for the pixel circuit;

acquiring a maximum driving voltage $M_2$ for a second pixel row in the pixel circuit and comparing $M_1$ with $M_2$, if $M_1<M_2$, maintaining the value of $M_2$, and if $M_1 \geq M_2$, assigning the value of $M_1$ to $M_2$;

configuring $M_2$ as the driving voltage for the pixel circuit;

acquiring a maximum driving voltage $M_n$ for an $n^{th}$ pixel row and comparing $M_{n-1}$ with $M_n$, if $M_{n-1}<M_n$, maintaining the value of $M_n$, and if $M_{n-1} \geq M_n$, assigning the value of $M_{n-1}$ to $M_n$; and configuring $M_n$ as the driving voltage for the pixel circuit, wherein n is an integer greater than 2.

3. An apparatus for adjusting a driving voltage for a pixel circuit comprising a plurality of sub-pixel circuits that form a plurality of pixel rows, the apparatus comprising: a driving power integrated circuit (IC) coupled to the pixel circuit, and an operational processing module coupled to the driving power IC and which includes:

a row buffering unit configured to acquire data voltages for each sub-pixel circuit in a pixel row to be scanned; and a calculating unit configured to calculate a minimum driving voltage for each sub-pixel circuit in the pixel row to be scanned in accordance with the data voltages, select a maximum value from among the minimum driving voltages, compare the determined maximum driving voltage for the pixel row to be scanned with maximum driving voltages for one immediately previous row before the pixel row to be scanned, keep the determined maximum driving voltage for the pixel row to be scanned unchanged, in response to a first determination result where the determined maximum driving voltage for the pixel row to be scanned unchanged is greater than the maximum driving voltages for the one immediately previous row before the pixel row to be scanned, and change the determined maximum driving voltage for the pixel row to be scanned unchanged into the maximum driving voltages for the immediately previous row before the pixel row to be scanned, in response to a second determination result where the determined maximum driving voltage for the pixel row to be scanned unchanged is smaller than or equal to the maximum driving voltages for the one immediately previous row before the pixel row to be scanned.

4. The apparatus according to claim 3, wherein the operational processing module is integrated into the driving power IC.

5. A display device, comprising an apparatus for adjusting a driving voltage for a pixel circuit, wherein the apparatus comprises a plurality of sub-pixel circuits that form a plurality of pixel rows, and the apparatus comprises: a driving power integrated circuit (IC) coupled to the pixel circuit, and an operational processing module coupled to the driving power IC and which includes:

a row buffering unit configured to acquire data voltages for each sub-pixel circuit in a pixel row to be scanned; and a calculating unit configured to calculate a minimum driving voltage for each sub-pixel circuit in the pixel row to be scanned in accordance with the data voltages, select a maximum value from among the minimum driving voltages, compare the determined maximum driving voltage for the pixel row to be scanned with maximum driving voltages for one immediately previous row before the pixel row to be scanned, keep the determined maximum driving voltage for the pixel row to be scanned unchanged, in response to a first determination result where the determined maximum driving voltage for the pixel row to be scanned unchanged is greater than the maximum driving voltages for the one immediately previous row before the pixel row to be scanned, and change the determined maximum driving voltage for the pixel row to be scanned unchanged into the maximum driving voltages for the immediately previous row before the pixel row to be scanned, in response to a second determination result where the determined maximum driving voltage for the pixel row to be scanned unchanged is smaller than or equal to the maximum driving voltages for the one immediately previous row before the pixel row to be scanned.

6. The display device according to claim 5, wherein the operational processing module is integrated into the driving power IC.

7. The display device according to claim 5, wherein the display device is an active matrix/organic light-emitting diode (AMOLED) display device.

* * * * *